US009576488B2

(12) United States Patent
Hranac et al.

(10) Patent No.: US 9,576,488 B2
(45) Date of Patent: Feb. 21, 2017

(54) ANIMATION AND VISUALIZATION OF TRAFFIC DATA ANALYTICS IN A DASHBOARD PRESENTATION OF A ROADWAY PERFORMANCE MEASUREMENT SYSTEM

(71) Applicant: ITERIS, INC., Santa Ana, CA (US)

(72) Inventors: Robert C. Hranac, Petaluma, CA (US); Karl F. Petty, Orinda, CA (US); Eric Mai, Berkeley, CA (US); Brian A. Derstine, Ann Arbor, MI (US); Nicholas Hartman, Huntington Beach, CA (US)

(73) Assignee: ITERIS, INC., Santa Ana, CA (US)

( * ) Notice: Subject to any disclaimer, the term of this patent is extended or adjusted under 35 U.S.C. 154(b) by 256 days.

(21) Appl. No.: 14/076,092

(22) Filed: Nov. 8, 2013

(65) Prior Publication Data

US 2014/0136089 A1 May 15, 2014

Related U.S. Application Data

(60) Provisional application No. 61/724,377, filed on Nov. 9, 2012.

(51) Int. Cl.

| | |
|---|---|
| ***G08G 1/00*** | (2006.01) |
| ***G08G 1/0962*** | (2006.01) |
| ***G08G 1/0967*** | (2006.01) |

(52) U.S. Cl.

CPC ..... *G08G 1/0962* (2013.01); *G08G 1/09675* (2013.01); *G08G 1/096716* (2013.01); *G08G 1/096775* (2013.01); *G08G 1/096783* (2013.01)

(58) Field of Classification Search

None

See application file for complete search history.

(56) References Cited

U.S. PATENT DOCUMENTS

| | | | | |
|---|---|---|---|---|
| 7,813,870 | B2 * | 10/2010 | Downs | G08G 1/0104 340/995.13 |
| 2010/0185382 | A1 | 7/2010 | Barker et al. | |
| 2011/0282746 | A1 | 11/2011 | Nortrup | |
| 2015/0215177 | A1 * | 7/2015 | Pietrowicz | H04L 47/12 370/230 |

FOREIGN PATENT DOCUMENTS

| | | | |
|---|---|---|---|
| EP | 2177878 | A2 | 4/2010 |
| WO | WO 2009/080067 | A1 | 7/2009 |

* cited by examiner

*Primary Examiner* — Rami Khatib
(74) *Attorney, Agent, or Firm* — Lazaris IP

(57) ABSTRACT

Animation and visualization of roadway performance analytics in a dashboard presentation in an integrated performance measurement system comprises analyzing collected traffic data to generate measured congestion information that reflects current conditions in one or more links, segments, or corridors comprising a roadway. The measured congestion information is presented in one or more sets of indicia on a graphical user interface so that current congestion conditions can be viewed and analyzed by a user. The measured congestion information is represented as gauges displaying percentage increases or decreases relative to a particular time, as animated maps showing a selectable set of current congestion conditions, as one or more graphs of current congestion conditions over time, as chart-based displays of costs and causes of current congestion conditions, and a data feed listing textual live updates.

9 Claims, 5 Drawing Sheets

DASHBOARD PRESENTATION ON GUI
130
140
120
170
SERVER
166
MEMORY
164
WEATHER DATA INTEGRATION
155
WORK ZONE ANALYSIS
153
INCIDENT ANALYSIS
152
150
UPDATES
159
CORRIDOR ANALYSIS FUNCTION
151
CAUSES
158
COST ANALYSIS
154
TIMELINE FUNCTION
157
MAPPING FUNCTION
156
DATABASE
168
GRAPHICS MODULE
180
PROCESSOR
162
160
110
100
SENSORS
112
3RD PARTY DEVICES
114
WEATHER
118
OBSERVATIONS
116

ANIMATION AND VISUALIZATION OF TRAFFIC DATA ANALYTICS IN A DASHBOARD PRESENTATION OF A ROADWAY PERFORMANCE MEASUREMENT SYSTEM

CROSS-REFERENCE TO RELATED PATENT APPLICATIONS

This patent application claims priority to U.S. provisional application 61/724,377, filed on Nov. 9, 2012, the contents of which are incorporated in their entirety herein.

FIELD OF THE INVENTION

The present invention relates to an integrated performance measurement system for traffic management. Specifically, the present invention relates to displaying visualizations and animations of traffic data analytics in a dashboard presentation of current congestion conditions in an integrated roadway performance measurement system.

BACKGROUND OF THE INVENTION

There are many existing systems and methods for measuring traffic-related information for use in managing traffic on roadways. There are also many existing systems and methods of collecting such traffic-related information, as well as many existing systems and methods of presenting such information to users in a visualized manner.

Traffic-related information such as incidents, transit times through specific areas, commute times, work zones, and weather have a substantial impact on the performance of a roadway infrastructure, and analytical processing and measurement of such information has importance in a wide variety of situations. For example, entities and agencies responsible for traffic and/or roadway infrastructure management may need to plan for efficient use of time and personnel to perform maintenance works. Public emergencies often require priority use of roadways for response vehicles with minimal impedance. Costs are increased when transit vehicles and commercial goods carriers are unable to utilize roadways in an efficient manner. Commuting motorists also have a substantial economic interest in times-sensitive use of roadways. There is therefore a need for real-time, custom access to analytics of traffic-related information and for particular performance measurements of their impact on a roadway infrastructure.

There is a need among these existing systems and methods for data analytics tools that are capable of graphical presentation as real-time current congestion conditions for users who are responsible for traffic management. There is no presently-known way of aggregating collected traffic data and presenting current congestion condition metrics from analytical data processing functions performed thereon in a usable format for traffic management personnel in an animated, visualized manner that is capable of being customized, configured, and manipulated as needed.

As roadways become more and more strained due to increased numbers of motorists and vehicles using them, the volume of data collected to measure conditions on these roadways has also grown. Analytics applied to that increasing volume of data is likewise helpful in assisting those responsible for traffic management to manage the strain on roadway infrastructure. It is also helpful to have an organized way of presenting current traffic or roadway conditions resulting from those analytics in a useful way. There is therefore a need not found among existing systems and methods of aggregating that large volume of data for analytical purposes and for presenting resulting data in useful way to aid traffic managers to perform the tasks associated with maintaining and managing roadway infrastructure.

One or more objects of the present invention will therefore be apparent from the summary and detailed description of the various embodiments presented below.

BRIEF SUMMARY OF THE INVENTION

One such object of the present invention to provide an analysis of collected traffic data and present performance measurement of the collected traffic data in an animated, visualized format that traffic management personnel can utilize to make informed decisions. It is another object of the present invention to provide performance measurement in multiple animated indicia on a graphical user interface, and still another object of the present invention to provide the ability to customize and configure the presentation of performance measurement in variety of ways to suit the needs of personnel responsible for traffic management.

The present invention provides a visualized presentation of animated data analytics that yield metrics in the form of performance measurement of traffic and of roadway infrastructure. Performance measurement includes current congestion conditions of traffic and roadways according to a number of factors, such as speeds, incidents, weather, work zones, and other characteristics.

This visualization of performance measurement is accomplished in a dashboard-style presentation of various indications of current congestion conditions in a roadway. The dashboard-style presentation provides information, selectable and customizable by users, in one or more animated sets of indicia that appear as widgets, gauges, maps, graphs, bar charts, pie charts, and scrolling feeds of textual information. The dashboard-style presentation is accessed via a display, screen or graphical user interface, and capable of being viewed with any type of personal computing system or device, such as a desktop, laptop, notebook or tablet computer, and mobile devices such as telephones and personal digital assistants.

In one embodiment of the present invention, a method of presenting roadway congestion performance information to a user comprises collecting traffic-related data representative of one or more characteristics of performance of traffic on a roadway and applying the collected traffic-related data to a plurality of data processing modules configured to analyze the one or more characteristics of performance of traffic on a roadway to generate measured congestion data representing a plurality of congestion data metrics for traffic management decision-making; converting the measured congestion data into sets of indicia in response to user selections on a graphical user interface in a computing environment, the sets of indicia configured to enable a visualized representation of the measured congestion data over time, the plurality of congestion data metrics including traffic congestion, vehicular demand, incident information, and work zone information on a segment of a roadway selected by the user; and rendering the sets of indicia as visualized representations of the plurality of congestion data metrics on the graphical user interface, the sets of indicia including a one or more gauges, an animated map capable of being configured to show different current congestion conditions and different animations in a playback mode over a specified of time when so selected by a user, a graphical timeline, at least one cost chart representing costs consumed, a causes chart representing one or more causes of traffic congestion, and a textual data feed providing real-time congestion information for the roadway.

In another embodiment of the present invention, a method of visualizing measured traffic data in an integrated roadway performance measurement system comprises analyzing collected traffic data in a plurality of data processing modules configured to generate output data representative of traffic congestion that includes current congestion conditions in a roadway, the plurality of data processing modules integrating sensor data, navigational data, weather data, and observational data to determine an overall performance of the roadway, an impact of incidents occurring on the roadway, and an impact of work zones implemented on the roadway; and presenting the current congestion conditions in a plurality of sets of indicia on a graphical user interface, the output data representative of traffic congestion being selected and manipulated by a user so that the current congestion conditions are visually rendered for display in a dashboard-style presentation for a selected portion of a roadway, the plurality of sets of indicia including at least one gauge, an animated map having a playback mode in which current conditions are animated over a specific period of time, a graphical timeline, a chart-based display of costs, a chart-based display of causes, and a listing of live, written updates listed in a data feed.

In still another embodiment of the present invention, a system for visualizing and animating roadway performance data comprises a computer processor and at least one computer-readable storage medium operably coupled to the computer processor and having program instructions stored therein, the computer processor being operable to execute the program instructions to perform one or more data processing functions on collected traffic-related data to generate output data representative of current congestion conditions on a selected portion of a roadway and convert the output data representative of current congestion conditions on a roadway into a plurality sets of indicia in response to user-provided selections, and display the plurality of sets of indicia on a graphical user interface to a user, the plurality of sets of indicia including at least one gauge, an animated map having a playback mode in which current congestion conditions are animated over a specific period of time, a graphical timeline, a chart-based display of costs, a chart-based display of causes, and a listing of live, written updates listed in a data feed.

Other objectives, embodiments, features and advantages of the present invention will become apparent from the following description of the embodiments, taken together with the accompanying drawings, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

In the following description of the present invention reference is made to the accompanying figures which form a part thereof, and in which is shown, by way of illustration, exemplary embodiments illustrating the principles of the present invention and how it is practiced. Other embodiments will be utilized to practice the present invention and structural and functional changes will be made thereto without departing from the scope of the present invention.

An integrated traffic performance measurement system is a management tool for aggregating traffic-related data from various sources and computing performance measures or metrics for a roadway infrastructure. In such a system, an extensive set of reporting functions enable customized visualizations and animations for transportation engineers and others responsible for maintaining and operating roadways. Data for these reporting functions is collected using a network of sensors, placed in or near roadways, using other systems such as radar and video cameras, and using data processing techniques to generate information from other speed and/or traffic-related data provided by, for example, Global Positioning System (GPS) and Bluetooth devices. Data from these types of sources is further processed and analyzed to create multiple measurements for use in traffic management.

Figure 2:
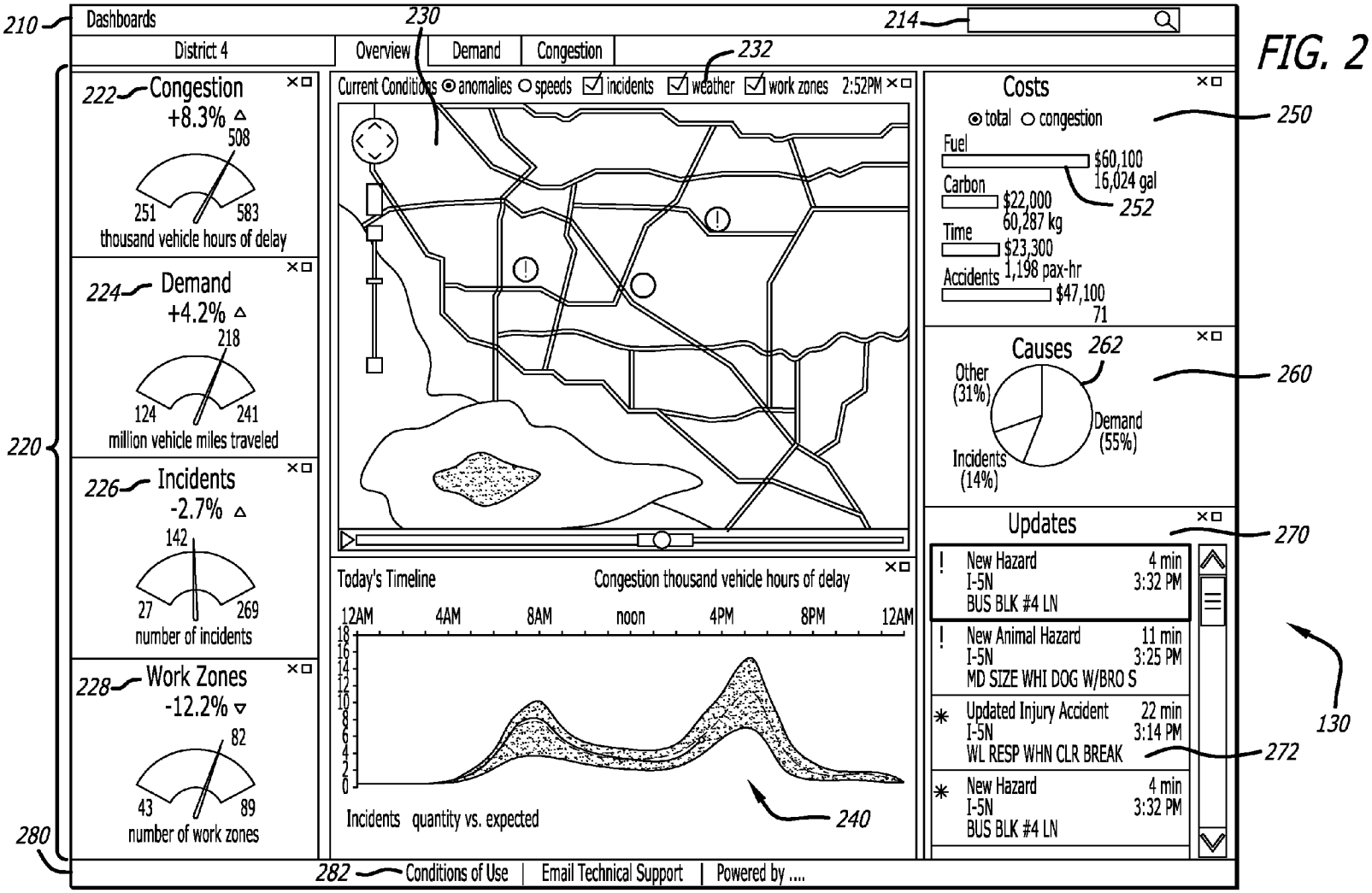
FIG. 2 is a screenshot of a dashboard-style presentation of roadway performance metrics for current congestion conditions according to the present invention.

The present invention is, in one embodiment of the present invention, a system and method of visualizing and animating data analytics of current traffic and roadway congestion conditions in a dashboard presentation, shown herein for example in FIG. 2, in an integrated performance measurement system for traffic management. Data analytics used in the present invention may be performed using many different methods and system components. Generally, data analytics presented on the dashboard of the present invention as shown in FIGS. 2-8 involve the use of one or more processors and memory modules having program instructions configured for execution thereon to perform a plurality of data processing functions, such as modeling of input in the form of collected traffic-related data to generate output data representative the current traffic and roadway congestion conditions.

Figure 1:
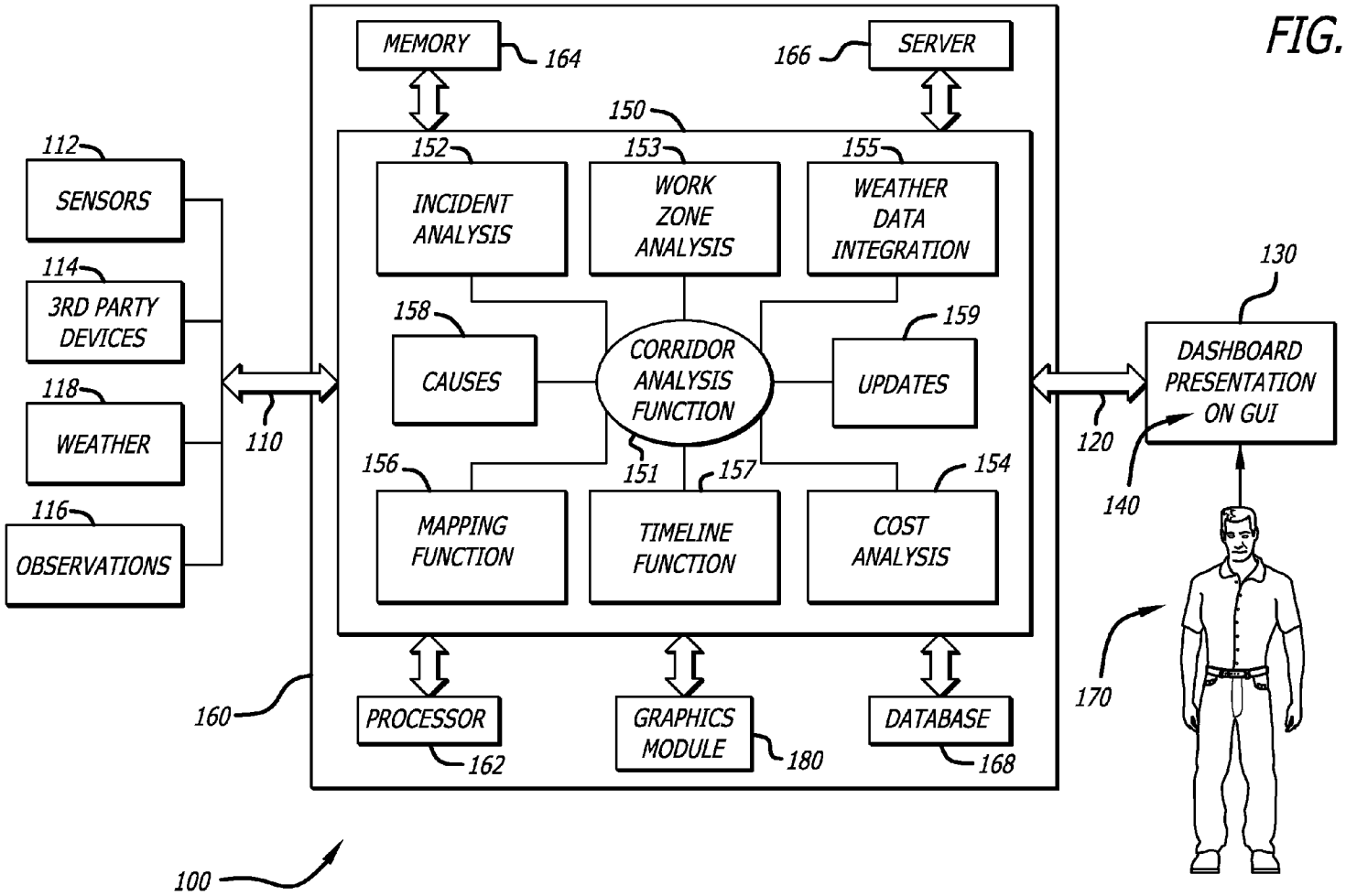
FIG. 1 is a block diagram of a system of processing traffic-related data to generate output data for a dashboard-style presentation of roadway performance metrics for current congestion conditions according to the present invention.

FIG. 1 is a diagram showing steps in a system 100 that processes traffic-related data 110 and generates output data 120 for the dashboard-style presentation 130 on a graphical user interface 140, as shown in the screenshot of FIG. 2. The system 100 of the present invention ingests the traffic-related data 110 from signals generated from multiple sources as noted above, for example from sensors 112 such as those placed in or near roadways, including but not limited to radar systems and video cameras, and from other systems 114 such as GPS and Bluetooth devices, observations 116 from crowd-sourced-based providers such as third parties operating applications on mobile devices, and weather systems 118. These sources generate the collected, traffic-related data 110 that is used to determine traffic congestion characteristics relative to roadway performance, such as vehicular speed, position, and flow, and other factors affecting these traffic characteristics, such as incidents, weather, work zones, and other maintenance activities.

The data collected from these multiple sources is applied to one or more data processing functions 150 within the present invention to measure current congestion conditions relative to a given segment of a roadway infrastructure by determining the traffic characteristics and factors affecting those characteristics necessary. Current conditions that are measured within the present invention are at least relative to the information displayed in FIGS. 2-8, and include characteristics of roadway congestion such as usage demand, incident volume, and work zone volume. Other metrics of current conditions are also measured, such as costs associated with roadway activity and causes of road congestion conditions. Furthermore, the current conditions are blended with other information such as weather conditions, time, and maps to produce other presentations of data as shown in FIGS. 2-8.

Referring to FIG. 1, the system 100 includes a computing environment 160 in which the data processing functions 150 are embodied. The computing environment 160 at least includes processors 162, one or more memory modules 164, servers 166, and databases 168. The data processing functions 150 of the present invention perform several data manipulations in modeling the ingested data to generate the output data 120 representative of traffic characteristics and effectuating factors for the dashboard-style presentation 130 of current congestion conditions in FIG. 2.

Generally, these manipulations of ingested data are performed in one or more modules configured to process vehicular speed, location and volume over a period of time from signals generated from the multiple sources of data. These attributes are further analyzed in the data processing functions 150 to generate the measurements of current congestion conditions as shown in FIG. 2. For example, a "corridor" analysis function 151 models the overall performance of a roadway in terms of congestion along a particular link, segment or section forming a corridor of a roadway being analyzed by comparing speed, location, and volume information with expected figures for normal vehicular traffic flow along the particular corridor. From the various sensors acting as multiple sources of information, the present invention infers the speed of traffic and the number of vehicles using a segment of a roadway at any given time, and generates metrics to measure the usage of the roadway, expressed as demand by vehicular distance traveled, and also for the amount delay such demand produces. These metrics are used to visualize and analyze congestion and along a particular corridor in the widgets, gauges, map and timeline as shown in FIG. 2 and described further herein. The corridor analysis function 151 may also take incident and work zone activity into account by incorporating output data from specific data processing functions that model that activity, as described below.

Another data processing function 150 in the present invention is an incident analysis function 152 that determines a number of incidents occurring along a particular section of a roadway being analyzed. This function infers the existence of a problem at the section or corridor of the roadway by changes in speed, location and volume that are above a threshold value. For example, an incident can be inferred where average vehicular speed drops below a threshold value, or where bottlenecks are otherwise detected at a particular location. This inference may be modulated by other sources of data, such as crowd-sourced reporting that confirms the existence of a traffic incident. This data can then be used to generate metrics such as a number of incidents occurring over a particular time, or a map-based indicator. Regardless, this incident analysis function 152 is used to visualize and animate the occurrence of such incidents over a specified period time in the widgets, gauges, map, and timeline of FIG. 2, and as described further herein.

Similarly, a work zone analysis function 153 is a data processing function that indicates the presence and impact of work zones occurring along a particular section or corridor of a roadway being analyzed. This function models the impact of a work zone on performance of a roadway by changes in speed, location and volume that are above a threshold value. In one embodiment, this information is used to model overall performance of the roadway for the congestion and demand measurements as described above. Regardless, however, the present invention may incorporate data relative to known or planned maintenance operations, so that output of a work zone analysis function is capable of comparing changes in vehicular speed, location, and volume at particular points with known maintenance operations at those points to confirm a cause for changes in roadway performance. Output of this work zone analysis function 153 may therefore be used to generate metrics for visualization and animation of the occurrence of such maintenance operations in the widgets, gauges, map, and timeline of FIG. 2, and as described further herein.

It is to be noted that the work zones as contemplated herein may include both previously planned operations and activities conducted in response to real-time conditions, and at least for that reason, the present invention includes a work zone analysis function to properly account for maintenance activity as an aspect of overall roadway performance. For example, maintenance activity on a roadway may occur after a snow storm, involving snow plows or other equipment to apply treatments to a roadway surface. Therefore, the present invention contemplates that another source of data may be maintenance decision support systems that are capable of communicating information about a particular vehicle's activity, and/or the incidence of operational activity on a particular section of roadway. Regardless, the present invention contemplates that metrics of current conditions pertaining to work zones may take operational activity into account that is both planned maintenance (whether performed by agencies or entities responsible for such maintenance of contracted parties) and maintenance that is performed or deployed in real time based on current weather or other roadway conditions.

Another data processing function in the present invention is a cost analysis function 154, which determines costs of performance analytics measured for the segment or corridor of the roadway being viewed in the dashboard of FIG. 2. Costs are displayed in FIG. 2 as either total costs of roadway performance, or costs of congestion affecting performance. Regardless, the cost analysis function is configured to calculate a cost of certain aspects of roadway performance, such as time, accidents or incidents, fuel consumption, and carbon usage. These costs are relative to the congestion, demand, incident, and work zone information generated as output data from the data processing functions described above. The cost analysis function 154 is utilize to generate visualization of such costs over a specified period time at least in the "Costs" widget of FIG. 2, and as described further herein.

The present invention may also include a weather data integration function 155 that enables weather information to be incorporated into one or more of the data processing functions discussed herein. Weather may be a factor in vehicular speed, location and flow on a roadway, and therefore the present invention contemplates that weather data 118 from one or more sources of such information may be utilized to calculate metrics to measure congestion and demand on a particular section of a roadway. Weather data 118 may also be utilized to determine causes of congestion and demand, and may therefore displayed in a "Causes" widget as shown in FIG. 2. Weather data 118 may also be applied to functions that generate the animated map of conditions on the dashboard of FIG. 2, as we all for accurate reporting of information in the graphical representation of congestion in the timeline shown in FIG. 2. For example, when weather data 118 is highlighted or selected in the animated map widget, an overlay of current weather conditions is implemented on the animated. Similarly, appropriate indicia showing current weather conditions may be displayed in the timeline widget, along with the time indicia.

The weather data integration function 155 is therefore configured to ingest weather data 118 for the segments or corridors to be analyzed in the present invention. Such weather data 118 may be ingested from weather sensors or from weather analysis and prediction systems, and from non-traditional sources of information such as for example from crowd-sourced observations and social media feeds. The different sources of weather data 118 may include data from both in-situ and remotely-sensed observation platforms. For example, weather station data may be combined with data from weather radars, satellites, and computer models to reconstruct the current weather conditions on any particular link, segment or corridor of roadway. Additionally, the present invention may be configured to ingest data representative of weather variables from numerical weather prediction (NWP) models, regardless of whether publicly, privately, or internally provided or developed.

The present invention also includes a mapping function 156 that performs analytics to generate a map showing congestion, incidents, work zones, weather indicators, and other information for particular link, segment or corridor of a roadway. The mapping function utilizes speed, location and volume information to generate data for visualization and animation on a map overlay for the dashboard of FIG. 2, as described further herein. The mapping function 156 generates the visualizations and animations based on user-selected preferences, so that different data may be displayed on the dashboard of FIG. 2. For example, users may select from "anomalies," "speeds," "incidents," "weather," and "work zones," or any other category of information that the present invention is capable of presenting. Accordingly, the mapping function 156 has the ability to generate output data for the map-based display based many different factors for a selected link, segment or corridor of a roadway.

Also included among the data processing functions is a timeline function 157, which receives the collected traffic-related data 110 and generates graphical congestion data over the course of a 24-hour day as shown in FIG. 2. It should be noted that the graph shown in FIG. 2, plotted as hours of vehicle delay over time, can be configured for any desired period of time. Regardless, this data processing function generates, as output data, a plotted display of congestion information based on speed, location, and flow data as noted above in the corridor analysis function. The timeline function 157 therefore takes data output by this corridor analysis function and generates the plotted graph, as shown for example in FIG. 2. Other data may also be plotted in the timeline function, such as incident data.

As suggested above, the present invention may provide a graphical display of causes of congestion on a roadway. FIG. 2 shows a "Causes" widget which displays, for example, a pie chart indicating percentage amounts of causes of congestion on a selected roadway link, segment or corridor. This function is performed by a causes function 158 among the data processing functions of the present invention, which receives the collected traffic-related data, determines current causes of congestion, and generates output data displayed as percentage values in the chart-based indicia as shown for example in FIG. 2 and FIG. 7.

Figure 8:
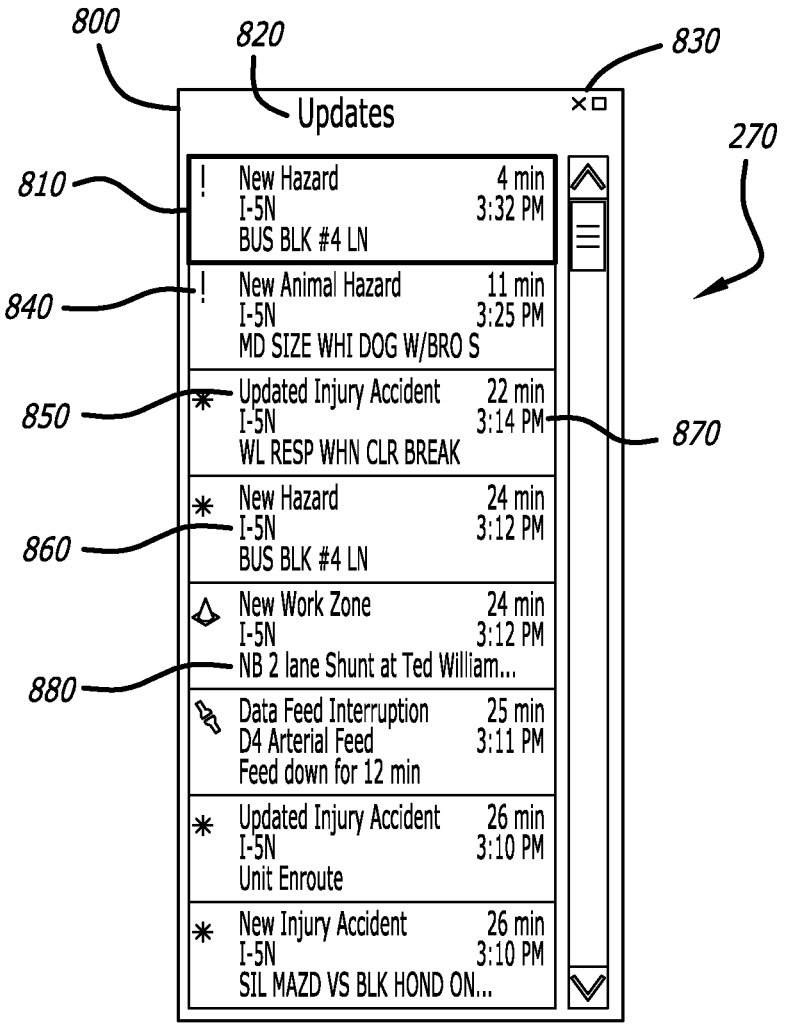
FIG. 8 is an enlarged view of an exemplary set of indicia for a data feed of updates displayed on the dashboard-style presentation of roadway performance metrics current congestion conditions according to the present invention.

An updates function 159 receives collected traffic-related data 110 and integrates real-time information therein into the dashboard-style presentation 130 by creating a "feed" of data that shows textual and/or icon-based updates of activity on the selected link, segment, or corridor of the roadway, as shown in FIG. 8. The updates function 159 creates and displays such textual or icon-based information as another presentation of information shown in one or more of the widgets or gauges of FIG. 2. The updates function 159 may also ingest traffic-related data from other sources of updates on traffic conditions on the roadway, such as for example from social media feeds or crowd-sourced observations via applications on mobile devices. Regardless of whether such updates are generated from other data processing functions 150, from sensor data 112, from third party systems 114, from third party observations 116, or from weather systems 118, the updates function 159 is displayed as another set of indicia on the dashboard of FIG. 2 as discussed further herein.

The present invention also enables one or more users 170 to interact with the dashboard-style presentation 130 on the graphical user interface 140 to customize the gauges, widgets, maps, and other indicia presented as in FIG. 2. The dashboard-style presentation includes pull-down menus, dialog boxes, and other items that enable users 170 to enter or select options for display of data, as described further herein. Accordingly, the computing environment 160 may further include one or more graphics modules 180 for generating indicia for display on the graphical user interface 140 and for processing user 170 interactions that instruct the data processing functions 150 to generate user-specified data.

The present invention contemplates that the processors 162, the memory 164, the server 166, the database 168, and the graphics module 180 are integrated in the computing environment 160 to perform the data processing functions 150 as described herein, across one or more modules that execute specific program instructions in machine-readable code. These components are also configured to convert the output data 120 representative of current congestion conditions on a selected link, segment or corridor of a roadway into sets of indicia for display in the dashboard-style presentation 130 on the graphical user interface 140 as shown in FIG. 2, including both static graphical representations and animated representations that change over time, for example in a playback mode. As noted above, many different types of data processing may be utilized to achieve the desired output data. These different types of data processing represent multiple mathematical operations applied to manipulate the collected input data to arrive at the data displayed as in FIG. 2.

FIG. 2, as noted throughout, is an exemplary screenshot of a dashboard-style presentation 130 of current traffic congestion conditions experienced on a selected section of a roadway. The dashboard 130 presents data in multiple sections, which may also be referred to herein as schema or representations, so that it can be both animated and visualized for user decision-making. The multiple schema include a header 210, a plurality of gauges 220, at least one animated map 230, a timeline 240, a costs section 250, a causes chart 260, an updates feed 270, and a footer 280. Data may be organized and represented in a variety of different forms and formats, and it is to be understood that the present invention is not to be limited to any one form or format referenced herein.

The header 210 is a section of the dashboard 130 that indicates navigational and product branding elements 212. Navigational elements 212 may include links presented to users of the performance measurement system to other areas, such as for example other dashboards or views, maps, reports, user profiles, and tools such as help and logout. Product branding elements 212 may include a logo, a version number, and an implementation identifier, such as the name or logo of the organization or agency with whom the dashboard is implemented. A search box 214 may also be included to allow users 170 to search for specific keywords or information. The header section 210 may be positioned horizontally or vertically on the dashboard 130, may be positioned in many different locations within the dashboard 130. The footer section 280 of the dashboard 130 may include additional links 282, such as for notifications.

Gauges 220 may also be included within the schema presented on the dashboard 130 as noted above. Each gauge 220 appears similar to a widget in a computer operating system desktop and provides overviews of different categories of data. Examples of these different categories may include congestion 222 (such as delay represented in vehicle-hours) demand 224 (represented as vehicle-miles traveled), incidents 226, work zones 228. Assets 229 (not shown), such as quantity or type of traffic-related data 120 received, may also be displayed.

Traffic information may also be displayed within the schema presented in the dashboard 130 in one or more animated maps of an animated map 230. The one or more animated maps also appear similar to a widget in a computer operating system desktop and can be configured to display current or most-recent traffic conditions, such as for example congestion or speed, a weather radar overlay, work zones, and incidents. The dashboard 130 includes animation controls 232 that allow the user to view an animation of the current day, anywhere from midnight to a most recent time. Other animation controls 260, as noted herein, are also contemplated within the animated map section 230 of the dashboard 130.

A timeline section 240 may also be displayed within the schema presented on the dashboard 130. The timeline section 240 may also appear in a manner similar to a widget in a computer operating system desktop. The timeline section 240 displays a time series chart 242 of traffic congestion (shown, for example, in vehicle-hours of delay) and incidents. As shown for example in FIG. 1, the time-series chart 242 may be configured to show at least three types of data: in line form, the day's congestion up to a most recent time; in an area gradient, a past year's congestion distribution, by hour; and an incident area, showing the day's hourly incidents and the difference from the past year's median by the hour. The timeline 240 can be configured to show other types of data among the different views as well.

A costs section 250 may also be displayed within the schema presented on the dashboard 130. The costs section 250 displays charts 252 (in bar chart form as shown in FIG. 2) of total and excess costs due to various factors such as fuel use, $CO_2$ emissions, time lost, and accidents. A causes section 260 may also be displayed within the schema as shown in FIG. 2, and configured to show a chart 262 (in pie form in FIG. 2) of the day's congestion sources up to a most recent time. Additional schema shown on the dashboard include an updates section 270, which may be configured to display textual information 272 such as real-time incidents and other real-time data as collected by the system 100. Such information is to be displayed in the style of a scrolling feed, and may be configured to appear in most-recent on top, or most-recent on bottom. A slide bar may also be provided to enable a user 170 to scroll through updates, such as the vertical slide bar shown in FIG. 2.

Figure 3:
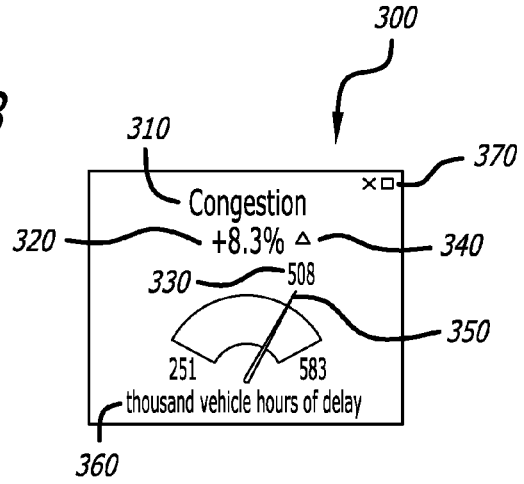
FIG. 3 is an enlarged view of an exemplary set of indicia for a gauge displayed on the dashboard-style presentation of roadway performance metrics for current congestion conditions according to the present invention.

FIG. 3 is an enlarged view of an exemplary set of indicia in a gauge 300 for the gauges section 220. Each gauge 300 indicates a plurality of information to the user 170 of the dashboard 130. For example, each gauge 300 may show a title 310 that provides a brief textual category for the data displayed (i.e. Congestion, Demand, Incidents, Work Zones, Assets). A gauge 300 may also display a percentage value 320 as a "Current Percent," which is the current value's percentage 320 above or below a "normal" value (i.e. the $50^{th}$ percentile value). The "Current Percent" may be a value 320 equal to +/−((current value/$50^{th}$ percentile value)−1), where the minimum value is ((min value/$50^{th}$ percentile value)−1), the maximum value is ((max value/$50^{th}$ percentile value)−1), and where normal is 0%. For example, assume min=40,200 and max=84,200 and median=50,000. In a first exemplary calculation, assuming the current value is 55,100, the current percent is therefore +10.2%. In a second exemplary calculation, assuming the current value is 40,200, the current percent is therefore −19.6%. In a third exemplary calculation, assuming the current value is 84,200, the current percent is therefore +68.4%. In a fourth exemplary calculation, assuming the current value is 50,000, the current percent is therefore 0%.

Each gauge 300 also indicates a "Current Value" 330 which is the current numeric value of the data to be displayed in the particular gauge 300. The calculation of this data reflects the cumulative value for the current day's information from midnight to within a certain deviation of a present time, for example, the past 5 minutes. The gauge 300 itself displays a distribution representative of a certain period of time, such as for example one year. The distribution is a histogram of the past data over the period of time for the range identified in the current value, and the specific day in which that range for the current value is recorded. The histogram may further utilize additional indicia such as color to show, for example, lighter colors for less common values, and darker colors for more common values. The histogram in the gauge may also indicate minimum and maximum values of the distribution.

Additionally, arrows 340 or other similar indicia may be present to show either up, down, or flat to indicate whether the current value 330 is higher, lower, or the same as a previous current value 330. A needle 350 is also part of the gauge 300, pointing to the location of the current value 330 in the range shown by the gauge 300. The gauges section 220 may further indicate the units displayed by the gauge 300 in a short description 360 for the current, minimum, and maximum values. There are also widget controls 370 which allow the user 170 to close the gauge 300 if desired, and to click and drag the gauge 300 to a different part of the dashboard 130.

Figure 4:
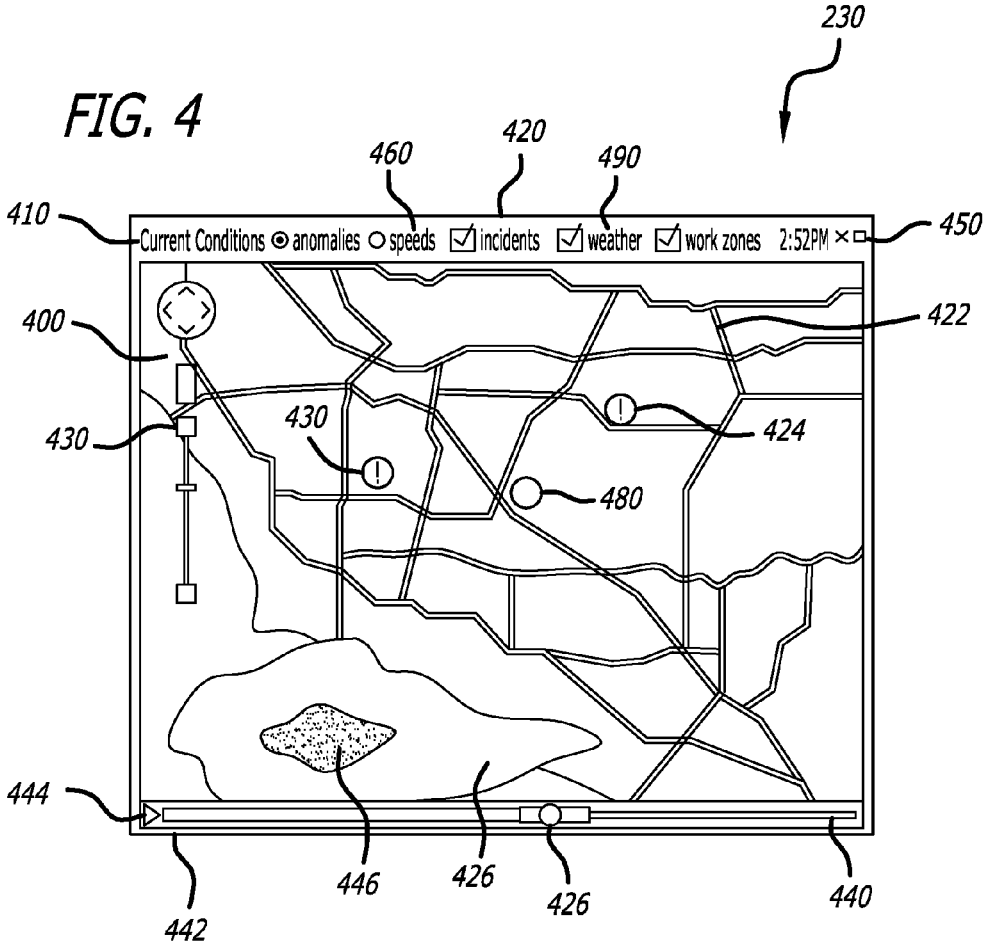
FIG. 4 is an enlarged view of an exemplary set of indicia for an animated map displayed on the dashboard-style presentation of roadway performance metrics for current congestion conditions according to the present invention.

FIG. 4 is an enlarged view of an exemplary set of indicia in an animated map section 230. Each animated map section 230 includes a base map 400 that indicates a plurality of information to the user 170 of the dashboard 130. The base map 400 includes a textual map title 410 and several overlay toggles 420 which enable different overlays of data to be displayed on the base map 400. These overlay toggles 420 include at least two speed toggles 422 that control whether speeds shown on the map are current speeds or anomalies. Other toggles turn various additional data on and off, such as incidents 424, weather 426, and work zones 428. Additional toggles may also be present.

The base map 400 may be configured to emphasize or deemphasize certain features, such as for example water, landscape, locality labels, and highways, arterial and local streets. The base map 400 may also include pan and zoom controls 430. However, these controls 430 may be disabled or removed from the schema so that the user 170 cannot alter the scale or view displayed. Many types of map styles are capable of being displayed as a base map 400, such as maps provided by Google, Bing, ESRI, OSM, and any other such map. The present invention is therefore not intended to be limited to any particular styled map.

The animated map section 230 may further include a playback timeline 440 that is positioned, for example, along a horizontal axis 442 of the animated map section 230 of the dashboard. The playback timeline 440 is a function that allows the user 170 to display data collected over the entire day from midnight to midnight in a playback format within the base map 400. Along the playback timeline 440 are pause and play control buttons 444 that control the animation playback. Available time is shown in a shaded area 446 of the timeline. The available time extends from midnight to the current time and updates in real time. All of weather, incident, speed, and work zone data may also be similarly updated when shown in the base map 400, but some of these may also update at different times due to different sources of such data.

The current time 448 is indicated by indicia along the available time in the playback timeline 440 that controls where the user 170 is along that playback timeline 440. The current time 448 is configured to default so as to correlate with the playback time shown in the upper portion of the animated map section 230. As noted above, the animated map section 230 shows a playback time 450, which is the current time 448 of the data displayed on the base map 400.

The animated map section 230 also includes a speeds overlay 460. There are two types of speeds which can be overlaid on the base map 400—current speeds or current speed anomalies. The speeds are displayed as four colored road overlays. Incident icons 470 may also be included in the animated map section 230, which show incidents from a live feed. These are displayed on the base map 400 at their location using the feed icons. Incidents are only intended to be displayed on the base map 400 during the time in which they are active incidents. Active work zone locations 480 may also be displayed as icons on the base map 400 at the location of their occurrence. Like incident icons, work zone icons are intended to be displayed only during the time in which they are active work zones. The animated map section 230 may also display weather data 490 in weather overlays, indicated in tiles with color ranges to show different levels of weather such as precipitation.

Figure 5:
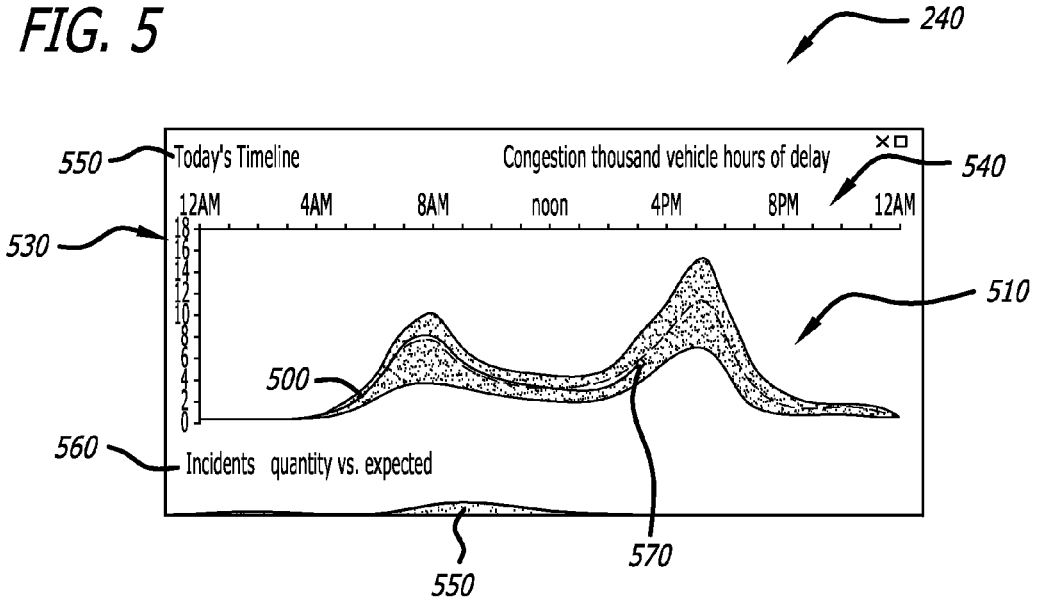
FIG. 5 is an enlarged view of an exemplary set of indicia for a timeline displayed on the dashboard-style presentation of roadway performance metrics for current congestion conditions according to the present invention.

FIG. 5 is an enlarged view of an exemplary set of indicia in a timeline section 240. A timeline 500 is a graphical representation of congestion, measured in vehicle-hours of delay, and incidents, presented according to one embodiment as a time series chart 510 to the user 170 of the dashboard 130. The timeline chart 510 includes a textual title 520 and other indicia describing the data shown, i.e. "Congestion," as well as the units. The axes of the timeline chart 500 are also described, with data shown in the vertical axis 530 and time displayed along the horizontal axis 540. The time along the horizontal axis 540 may be used for both the timeline chart 500 and the animated map 400, and is aligned with the playback timeline 440 of the base map 400. The time along the horizontal axis 540 of the timeline chart 500 shows the current day from midnight to midnight.

The timeline chart 500 may be configured to show data in many different representations, and may be displayed in more than one area. For example, in a main section of the timeline chart 500, shaded areas may be shown, in which a gradient may display a past year's data distribution by specific time periods. A dotted line may be displayed that represents a median, and additional indicia, such as shaded regions of darker or lighter colors, may represent additional information, such are more/less observations. One or more lines may also be shown. For example, a colored line may display a current day's data from midnight up to a most recent period. Different line colors may be displayed to indicate a position above or below the median value.

A secondary section 550 of the data displayed in the timeline chart 500, for example positioned below the main section, may have a separate textual title 560 associated with that section 550 to indicate the type of data therein. The secondary section 550 may be a smaller representation of data along the same timeline for quick visual reference rather than exact data display. Where this is the case, no vertical axis may be separately displayed for this secondary section 550 of data. The secondary section 550 of data may show data such as the current number of incidents, less the median number of incidents for the past year. Values above a 0 value would be, in this instance, above normal, while values below a 0 value would be below normal.

The timeline chart 500 may further display additional indicia to indicate a current time 570 of day in one or both of the main timeline 500 and the secondary section 550.

Figure 6:
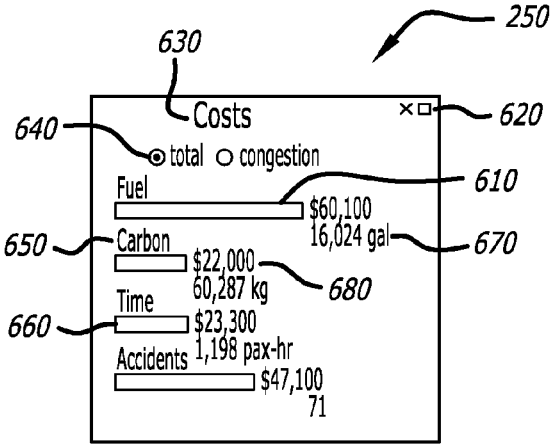
FIG. 6 is an enlarged view of an exemplary set of indicia for a costs chart displayed on the dashboard-style presentation of roadway performance metrics for current congestion conditions according to the present invention.

FIG. 6 is an enlarged view of an exemplary set of indicia in a costs section 250 in the dashboard-style presentation 130. This costs section 250 displays to users 170 of the system 100 one or more charts 610 indicating, for example, total and excess costs for various characteristics of performance measurement on a roadway. This section 250 may be presented in widget form as with other schema discussed herein, and includes a controls section 620 that permits users 170 to close the widget, resize the widget, or to click and drag to move the widget to a different section of the dashboard 130. The costs section 250 also includes a textual title 630 and content toggle 640 that allows users 170 to switch between, for example, total (such as today's cumulative costs so far) and excess (such as today's cumulative excess amount due to congestion). By selecting one or the other of the boxes next to the indicia for the content to be shown, the user 170 can quickly view different data and toggle between displays.

The costs section 250 shows different data for either the total or excess costs. Multiple data may be shown, and each item of data may be presented with its own title 650 and a bar 660 having a length corresponding to the monetary amount and a color corresponding to the current value's relationship to a normal value. For example, one color, such as red, may be used to indicate a value above normal, and a different color to indicate a value below normal. The quantity 670 for each item of data may also be displayed, such as the total or excess quantity, and indicated in its own units. Monetary units 680 may also be displayed for the total or excess quantity for each item of data, and explanations of details for calculating such monetary units may be available via documentation accessed from a "Help" function on the dashboard 130. Data contemplated to be shown in the costs section 250 includes Fuel, $CO_2$, Time, and Accidents, but many other data may also be displayed.

Figure 7:
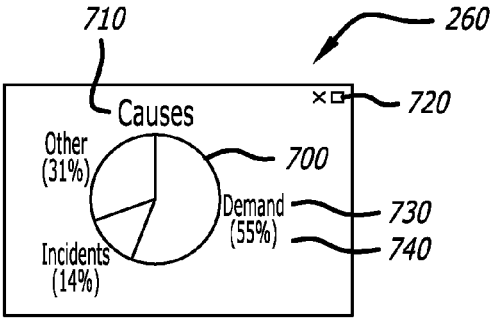
FIG. 7 is an enlarged view of an exemplary set of indicia for a causes chart displayed on the dashboard-style presentation of roadway performance metrics for current congestion conditions according to the present invention.

FIG. 7 is an enlarged view of an exemplary set of indicia in a causes section 260 in the dashboard presentation 130 to users 170 of the system 100. The causes section 260 indicates a breakdown of congestion sources up to a most recent time for a specified period of time. Causes may be presented in widget form as with other schema, and may present the data therein in the form of a chart 700, such as a pie chart, bar chart, or other graphical method. The chart 700 includes a textual title 710 and widget controls 720 that, as with other schema on the dashboard 130, permit users 170 to close the widget, resize the widget, or to click and drag to move the widget to a different section of the dashboard 130. Where a pie chart is used to display data, each item of data is presented as its own "slice" in the pie chart, and the pie may be shown as slightly exploded so that there is equal space between each slice. Each slice may also have a unique color to further highlight the different data shown to the user. Each slice may also be separately labeled with a category 730 and percentage value 740, which may be rounded to the nearest whole figure. Where a slice is too small to show the percentage value 740, it may be excluded from view, but may still be available to be shown with mouse-over activity.

FIG. 8 is an enlarged view of an exemplary set of indicia in a live feed of updates section 270 in the dashboard-style presentation 130 to users 170 of the system 100. The live feed of updates section 270 provides a data feed 800 of, for example, real-time incidents in items 810. Like other schema on the dashboard, the data feed 800 also includes a title 820 (such as for example "Updates") and widget controls 830, which as with other schema permits users 170 to close the widget, resize the widget, or to click and drag to move the widget to a different section of the dashboard 130. The data feed 800 may display the most recent item 810 at the top or at the bottom, pushing the other items 810 either down or up with the oldest item 810 bumped off the data feed 800, depending on the configuration. Alternatively, a user 170 may be able to scroll through updates using a slide bar, such as the vertical slide bar shown in FIG. 8. The most recent item 810 may be surrounded by a blinking or different-colored box to highlight it as the most recent item 810 in the data feed 800.

Each type of incident may be identified with a specific icon 840. Different types of incidents may include accidents, collisions, crashes (with sub-types of injury, non-injury, fatality), hazards, work zones, data feed interruptions, etc. Each item 810 in the data feed 800 may include a title 850, which may be a concatenated string composed of two elements. One element identifies the incident as "New" or "Updated" depending on whether it is a new or existing incident, and the second element includes the type of incident. The roadway direction 860 may also provided, as is the time 870 since the incident was reported to the nearest minute and the time of day it was reported. Finally, the content of the data feed 800 is indicated, with a textual description 880 of the incident. The schema may truncate the textual description 880 to fit within the provided area for the description.

The visualized and animated dashboard presentation 130 of data analytics of the present invention may also include additional data available for access by a user 170 when mouse-over movements are made in or near various schema. The user 170 may therefore access further information by simply positioning a cursor, using a mouse, over particular indicia in any of the schema presentations on the dashboard. For example, a user 170 wishing to learn more about how data is calculated may move the cursor over that set of data to call up a further "Help" or "More" link, for example, to further information about the analytics performed.

In a further embodiment of this aspect of the present invention, users 170 may be able to access additional, historical data by moving the cursor over particular indicia representative of data in the dashboard 130. Users 170 who are currently viewing data for a particular day may be able to access data for a previous day by moving the cursor over that data, and entering a data into a dialog box which appears after moving the cursor over that data. Users 170 may therefore be able to customize additional presentations of data simply by moving the cursor over existing widgets or indicia, and may further be able to adjust the presentation of data simply by moving their cursors over data being shown. In still another embodiment, when an animated map is in playback mode, users 170 may be able to access additional playbacks of historical data by the mouse-over activity described herein. Users 170 may therefore be able to view concurrent playbacks to compare current conditions with historical data, for example in a separate pop-up window. It is therefore contemplated that the dashboard 130 of the present invention may be configured to present additional information not immediately visible by mouse-over activity, and that any type of additional data analyzed by the system 100 for traffic management may be available in such a manner.

The system 100 of the present invention is performed, as noted herein, in a computing environment 160 comprised of multiple hardware, software, and firmware components that are configured to execute a plurality of instructions in one or more memory-based modules 164 to process incoming, collected traffic-related data 110 collected by the various sources of such data discussed herein in the data processing functions 150. These data processing functions 150 may be further implemented in conjunction with many different hardware components, such as a special purpose computer, a programmed microprocessor or microcontroller and peripheral integrated circuit element(s), an ASIC or other integrated circuit, a digital signal processor, electronic and/or digital logic circuitry, a programmable logic device or gate array such as a PLD, PLA, FPGA, PAL, and any other comparable components. In general, any means of implementing the systems and methods illustrated herein may be used to implement the various embodiments and aspects of the present invention. Examples of devices that can be used for the present invention includes computers, handheld devices, telephony-enabled devices (e.g., cellular, Internet enabled, digital, analog, hybrids, and others), and other such hardware components, machines, and apparatuses. These may include processors (e.g., a single or multiple microprocessors), memory, nonvolatile storage, and other peripheral input devices, and output devices. Furthermore, alternative software implementations including, but not limited to, neural networks, distributed processing, parallel processing, or virtual machine processing can also be configured to perform the methods described herein.

The systems and methods of the present invention may also be partially implemented in software that can be stored on a storage medium, executed on programmed general-purpose computer with the cooperation of a controller and memory, a special purpose computer, a microprocessor, or the like. In these instances, the systems and methods of this invention can be implemented as a program embedded on personal computer, as a resource residing on a server or computer workstation, as a routine embedded in a dedicated measurement system, system component, or the like. The system can also be implemented by physically incorporating the system and/or method into a software and/or hardware system.

Additionally, the data processing functions 150 disclosed herein may be performed by one or more program instructions stored in or executed by such memory, and further may be performed, as noted above, by one or more modules configured to carry out those program instructions. Modules are intended to refer to any known or later developed hardware, software, firmware, artificial intelligence, fuzzy logic, expert system or combination of hardware and software that is capable of performing the data processing functionality described herein.

It is to be understood that other embodiments will be utilized and structural and functional changes will be made without departing from the scope of the present invention. The foregoing descriptions of embodiments of the present invention have been presented for the purposes of illustration and description. It is not intended to be exhaustive or to limit the invention to the precise forms disclosed. Accordingly, many modifications and variations are possible in light of the above teachings. For example, the corridor analysis function may include logic that estimates congestion using Annual Average Daily Traffic (AADT) values that are provided by the Federal Highway Administration (FHWA), together with other traffic-related data ingested. It is therefore intended that the scope of the invention be limited not by this detailed description.

The invention claimed is:

1. A method of presenting roadway congestion performance information to a user, comprising:

collecting traffic-related data representative of one or more characteristics of performance of traffic on a roadway and applying the collected traffic-related data to a plurality of data processing modules configured to analyze the one or more characteristics of performance of traffic on a roadway to generate measured congestion data representing a plurality of congestion data metrics for traffic management decision-making;

converting the measured congestion data into sets of indicia in response to user selections on a graphical user interface in a computing environment, the sets of indicia configured to enable a visualized representation of the measured congestion data over time, the plurality of congestion data metrics including traffic congestion, vehicular demand, incident information, and work zone information on a segment of a roadway selected by the user; and rendering the sets of indicia as visualized representations of the plurality of congestion data metrics on the graphical user interface, the sets of indicia including a one or more gauges, an animated map configured to show different current congestion conditions and different animations in a playback mode over a specified period of time when so selected by a user, a graphical timeline, at least one cost chart representing costs consumed, a causes chart representing one or more causes of traffic congestion, and a textual data feed providing real-time congestion information for the roadway.

2. The method of claim 1, further comprising updating the graphical user interface so that the sets of indicia are displayed to the user as of a most recently-specified time.

3. The method of claim 1, wherein the traffic-related data is collected from a plurality of sources that include one or more of a network of traffic sensors, navigational and positional systems, weather instruments, and observations of motorists using the roadway.

4. The method of claim 3, wherein the navigational and positional systems include global positioning system devices, and wherein the observations of motorists are captured on mobile devices.

5. The method of claim 1, further comprising applying the collected traffic-related data to a corridor analysis function in the plurality of data processing modules to determine an overall performance of the roadway by comparing speed, location, and volume information with known traffic information for a specified period of time.

6. The method of claim 1, further comprising applying the collected traffic-related data to an incident analysis function in the plurality of data processing modules to determine a number of incidents occurring on the roadway by comparing changes in speed, location and volume with a threshold value.

7. The method of claim 1, further comprising applying the collected traffic-related data to a work zone analysis function in the plurality of data processing modules to determine a presence and impact of work zones occurring on the roadway by comparing changes in speed, location and volume with a threshold value.

8. The method of claim 1, wherein rendering sets of indicia further comprises generating the animated map from collected traffic-related data in a mapping function in the plurality of data processing modules, the mapping function configured to combine animations of congestion, incidents, and work zones with a map of a selected location.

9. The method of claim 8, further comprising integrating weather data with the collected traffic-related data in a weather data integration function to generate a weather animation for the mapping function where user-specified instructions require a weather overlay for the animated map.

* * * * *